United States Patent [19]

Haneda et al.

[11] Patent Number: 4,464,041

[45] Date of Patent: Aug. 7, 1984

[54] DEVELOPING APPARATUS

[75] Inventors: Satoshi Haneda; Takashi Ito; Ken Nakamura; Makoto Tomono, all of Hachioji, Japan

[73] Assignee: Konishiroku Photo Industry Co., Ltd., Tokyo, Japan

[21] Appl. No.: 353,091

[22] Filed: Mar. 1, 1982

[30] Foreign Application Priority Data

Mar. 17, 1981 [JP] Japan ..... 56-38262

[51] Int. Cl.[3] ..... G03G 15/00

[52] U.S. Cl. ..... 355/3 DD; 118/653

[58] Field of Search ..... 355/3 DD; 118/653

[56] References Cited

U.S. PATENT DOCUMENTS 4,386,577 6/1983 Hosono et al. ..... 355/3 DD 4,386,845 6/1983 Miyoshi et al. ..... 355/3 DD

*Primary Examiner*—J. V. Truhe

*Assistant Examiner*—David Warren

*Attorney, Agent, or Firm*—Jordan B. Bierman; Linda Bierman

[57] ABSTRACT

In the developing apparatus for producing an electrostatic latent image on a charge retaining member such as a drum, a rotating member for producing a shifting magnetic field is used to transport magnetic toner from a toner source to a developing area on the drum. The amount of toner so transported is regulated by the present invention by a magnetizable member positioned adjacent the rotating member in front of the developing area, the magnetizable member being characterized by a curved surface on which a shifting magnetic field is induced by the said rotating member and which attracts excess toner from the latter.

10 Claims, 6 Drawing Figures

DEVELOPING APPARATUS

BACKGROUND OF THE INVENTION

1. Field of the Invention

The present invention relates to a developing apparatus which produces an electrostatic latent image, and more particularly to developing apparatus using a magnetic developer. The present invention provides a developing apparatus which is equipped with a developer quantity regulating means designed so that the magnetic developer can be uniformly and thinly supported on a developer transporting means supplying magnetic developer, which is a magnetic developer used in a one-component developing process, or supplying a magnetic carrier which is a magnetic developer used in a two-component developing process to a developing area.

2. Description of the Prior Art

In two-component developing processes which have so far been popular, they have had to use a developer comprising a toner and a carrier mixed in a certain ratio, and have replenished the toner so that the ratio mix of said toner and carrier can constantly be kept uniform in order to make an image density stable; in contrast therewith, in one-component developing process which uses a developer without a carrier and is composed of only a toner, and there is no problem with the mixing ratio, and therefore a simply constructed developing apparatus is practicable.

The toner used in a one-component developing process has to be transported to the developing area by some method or other. A toner transporting method being popularly used in the one-component developing process is that when a magnetic toner is to be used as to said toner as in the following description, as for the said developer transporting means there is arranged a non-magnetic outer cylindrical member (i.e., a sleeve) and, inside the said sleeve, a cylindrical magnetic rotating member (i.e., a rotating member having field poles alternately arranged along the direction of the rotation, and of which the same number of N- and S-poles can be arranged, for example, they are arranged in the order of S-pole, N-pole, S-pole, N-pole, . . . ; and hereinafter referred only to as magnet roll) which is co-axial with said sleeve, and said magnetic toner magnetically adheres to said sleeve by applying a magnetic field onto the outer circumferential surface of said magnet roll, and at the same time said magnetic toner is moved and transported to the developing area by the movement of the magnetic field produced by the rotation of the aforesaid magnet roll.

Such a magnetic toner contains in the grains thereof, a magnetic powder such as a magnetite, and additionally a resin, a coloring agent such as carbon black, and an electric charge controlling agent. Now in a one-component developing process, if a uniform quantity of magnetic toner is not supplied to the developing area at the place proper time and for the said supply, there results adhesion blurs of a toner (a magnetic toner) to a toner image that is the primary image on an image supporting member after the development, and in turn, there also results an unevenness of the image density of copied material, and thus the overall copying performance is seriously lowered.

Therefore, it is desired that the magnetic toner (i.e., the thickness of said toner layer) should adhere to the sleeve very uniformly. The layer of said magnetic toner requires as a condition for forming a high quality copied matter and for improving an image transfer efficiency, not only the adhesion of said layer uniformly over to said sleeve, but also the adhesion between said layers, for example, within the limits of several to tens layers in the case where the grain diameter of magnetic toner is of the order of $10\mu$.

Heretofore, there have been proposed a variety of methods for forming a magnetic toner layer uniformly and thinly on the sleeve. In the early days, there has even been proposed and studied a method (i.e., a mechanical blade method) for scraping off (regulating) the magnetic toner from the sleeve mechanically by means of a plate-like member, however, in the this mechanical blade method, in order to regulate the thickness of said magnetic toner uniformly and very thinly, there were the problems that said mechanical blade member must be accurately manufactured, and that the space between the blade and the outer circumferential surface of said sleeve must be very accurately adjusted when the blade is to be fitted. Furthermore, in the said mechanical blade method, the thickness of magnetic toner actually formed varies with the grain diameter and the fluidity of said magnetic toner; however, said thickness becomes fairly greater than the space between the outer circumferential surface of said sleeve and said mechanical blade, and it was therefore very difficult to regulate the thickness of said magnetic toner to make it thinner. Still further, magnetic toner must pass through the very narrow space (the toner regulating area) between the outer circumferential surface of the sleeve and the mechanical blade that is the toner regulating member; therefore, there were some instances where strong pressure was applied adjacent the sleeve side of said mechanical blade, and said magnetic toner was forcibly cohered. Additionally, said toner regulating area becomes clogged with said cohered toner or toner cake which had been cohered by other causes, and consequently there produced, on the sleeve, an area not having adhering magnetic toner (e.g., an area where a line or a band is formed), and there was the serious danger that a white line, a white band or the like would appeared on a copy image.

Thereafter, with the purpose of making up for the defects of the developer regulating blade, there have been proposed various technologies as disclosed in Japanese Patent Publication Laid-open to Public Inspection No. 125844/1978, for example. In the drawings, FIG. 1 is a schematic diagram of the above-given described technology and the brief description thereof is as follows: Numeral 1 is a charge retaining member forming an electrostatic latent image, which rotates in the direction of the broken line and the arrow in the figure. When the layer of magnetic toner 6A is formed on the outer circumferential surface of a sleeve 3 so that magnetic toner 6 can be supplied to developing area 5, developer layer thickness regulating plate 7 comprising magnetic material is provided at the position opposite to the outer circumferential surface of sleeve 3 to regulate the layer of magnetic toner 6. The toner layer thickness regulating plate 7 is magnetically induced by a magnetic pole (i.e., N-polarity as in FIG. 1) of magnet roll 4 which is inside of sleeve 3 and is positioned opposite to the end of said layer thickness regulating plate 7, and by reason of a magnetic field generated between said regulating plate 7 being then inductively magnetized and the magnetic pole facing opposite thereto, it is difficult to pass the magnetic toner 6A through toner the regulating area 8 and as countermeasure, a developing means 2 capable of forming a layer of magnetic toner 6 thinly on sleeve 3 has been proposed. Numeral 6A shows a magnetic toner on sleeve 3 after it has passed through the toner regulation area 8. In accordance with above disclosed technology, it became possible to form a thin layer of magnetic toner more easily compared with the developer regulating means using said mechanical blade method; however, there were still some instances where the cohesion of magnetic toner occurred around the toner regulating area.

SUMMARY OF THE INVENTION

In the light of the aforegoing points at issue, it is an object of the present invention to provide a developing apparatus which can form an uniform and thin magnetic developer layer stably on the developer transporting means by using a magnetic developer (i.e., a magnetic toner or a two-component developer comprising magnetic carrier), preventing the cohering of said magnetic developer around the toner regulating area, and further preventing clogging by a toner coherent cake produced by other causes in the toner regulating area.

The object of the present invention can be accomplished by a developing apparatus comprising a developer transporting means adhering a developer on the surface, and transporting said developer to a developing area by applying a magnetic field, and a developer regulating means for regulating said transported developer to said developing area, characterized in that said developer regulating means comprises a magnetic member which is magnetically induced by said magnetic field and produces a shifting magnetic field by which developer is transported.

DETAILED DESCRIPTION OF THE PREFERRED EMBODIMENTS

The following examples of the present invention illustrate the application in a one-component developing process in which the quantity transportation of a magnetic developer (hereinafter referred to as a magnetic toner) to a developing area is regulated.

Figure 1:
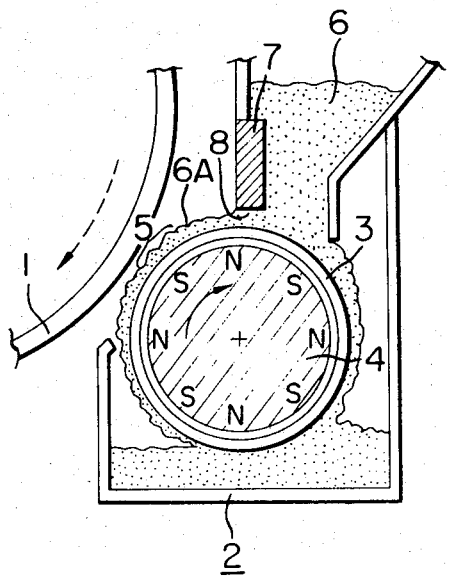
FIG. 1 is a cross-sectional schematic view of a known developing apparatus having used a one-component developing process in which a thickness of a toner layer was regulated by means of a conventional magnetic blade.
Figure 2:
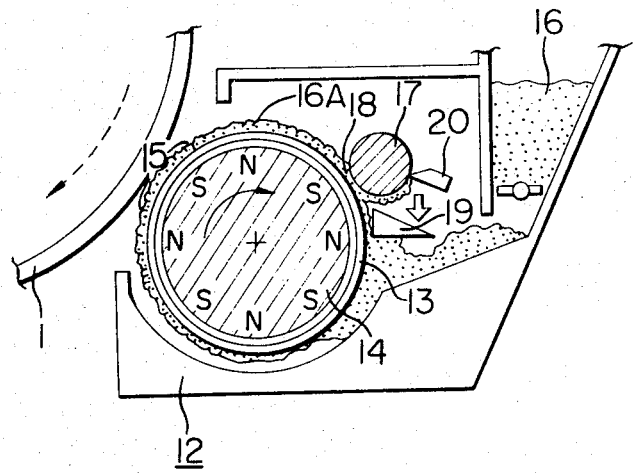
FIG. 2 is a schematic view of a developing apparatus of the present invention by which the thickness of a magnetic toner layer in a one-component developing process is regulated.

FIG. 2 is a schematic view of an example of the present invention, wherein a developing apparatus 12 is an apparatus for producing an electrostatic latent image on a charge retaining member 1 (for making a toner image) and in which there is provided a magnetic revolving member (a magnet roll) 14; a developer transporting means (that comprises magnet roll 14 and an outer circumferential member 13 arranged around magnet roll 14) for transporting the magnetic toner 16 to the developing area 15; a developer regulating means 17, formed mainly of magnetic material arranged in the vicinity of the outer circumferential surface of outer circumferential member 13 (hereinafter referred only to as a sleeve) and for regulating the quantity of the magnetic toner 16 being transported to the developing area 15; a scraping member 20, comprising rubbers, etc., for scraping off magnetic toner which has adhered onto and then moved with the surface of the developer regulating means 17, as indicated by the white arrow in FIG. 2; and a preliminary regulating member 19 for controlling developer quantity, formed of a dielectric material such as a resin or a slightly magnetizable material such as aluminium, and preliminarily regulating the quantity of the magnetic toner 16 ascending on the sleeve 13 by the revolving movement of the magnetic field produced by magnet roll 14 revolving in the direction of the black arrow and reaching a space between the developer regulating means 17 and the sleeve 13 (a toner regulating area 18=the developer regulating area).

In FIG. 2, it is also possible to serviceably position the preliminarily regulating member 19 so that magnetic toner having been scraped off from the developer regulating means 17 may not directly be dropped onto the neighborhood of the sleeve 13, but may be mixed with the fresh magnetic toner contained in the right hand side of developing apparatus 12 in the figure. Now, in FIG. 2 illustrating an example of the present invention, when the magnet roll 14 revolves (the normal speed of revolution thereof is at 100–2,000 rpm) in the direction of the black arrow, magnetic toner 16A on sleeve 13 moves in the opposite direction (counter-clockwise in the figure) to the revolving direction of the magnet roll 14. Consequently, in the developing area 15, it is possible to obtain a developing system such that the revolving direction (that is shown by the broken line and the arrow in the figure) of the charge retaining member 1 and the moving direction of magnetic toner 16A on sleeve 13 will be the same. The description will be made hereunder on the basis of the aforesaid developing system.

Figure 3:
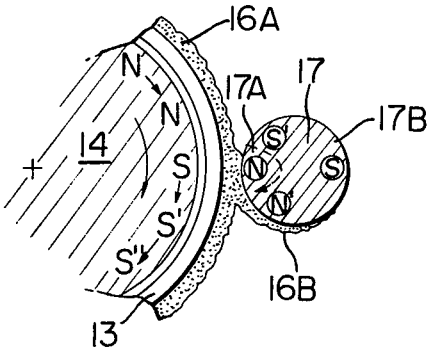
FIG. 3 is an enlarged partial view of the toner regulating area illustrating the moving direction of the polarities which are to be inductively magnetized inside the developer regulating means.

Referring now to FIG. 2 and FIG. 3, the process of the thickness of a magnetic toner layer, that is, the regulating process of the quantity of developer will be explained.

First, in FIG. 2, magnetic toners 16 in developing apparatus 12 (No replenishing means. mechanism is shown in the figure) adhere onto sleeve 13 (whose presence is indicated by magnetic toner 16A) and it is then transported on sleeve 13 by the magnetic attraction produced by the revolution of the magnetic poles of magnet roll 14 in the opposite directions to that of the black arrow. The layer thickness of magnetic toner 16A is regulated mechanically to the desired degree by means of preliminarily regulating member 19 at first and said magnetic toner 16A then ascends further on sleeve 13 and reaches the vicinity of the developer regulating means 17. As shown, for example, in FIG. 3, with respect to developer quantity regulating means 17, at the moment when the magnet pole of magnet roll 14 facing opposite to developer quantity regulating means 17 has been given the polarity of S by the magnetic induction of the magnetic poles arranged on magnet roll in order, namely, N-pole, S-pole, N-pole . . . , opposite side 17A (the circumference of the area enclosed with the broken-line) facing magnet roll 14 is magnetized to the polarity of Ⓝ , while side 17B not facing magnet roll 14 is magnetized to a polarity of Ⓢ. ( Ⓝ and Ⓢ mean the magnetic polarities which were respectively magnetically induced.). Next, as magnet roll 14 revolves a little after the said moment in the direction of the black arrow shown in FIG. 3, said polarity of S in magnet roll 14 moves to the position of the polarity of S' and correspondingly, said polarity Ⓝ of the developer regulating means 17 moves to the position of the polarity Ⓝ', and thus the magnetic field produced between said polarity S' of magnet roll 14 and said polarity of Ⓝ' becomes weak. At the same time, the area of magnet roll 14 oppositely facing the developer regulating means 17 has the polarity Ⓝ', and correspondingly, side 17A of developer regulating means 17 oppositely facing said magnet roll 14 is inductively magnetized into the polarity Ⓢ'. In other words, in the circumference of side 17A of developer regulating means 17 oppositely facing magnet roll 14, there are generated movements of inductively magnetized poles that correspond to the counterclockwise revolution (in FIG. 3) that is opposite to the direction of the revolution of magnet roll 14.

It is particularly desirable that a developer quantity regulating means comprising a magnetic substance are of the ferromagnetic material (highly magnetically permeable materials) represented by iron or ferrite, for example, which are apt to easily be magnetized in a magnetic field, and from the viewpoint of the configuration thereof, it is also desirable that a part of the material does not produce a stronger magnetic attraction than those produced in other parts thereof in a magnetic field, that is, it has a shape of, for example, a cylinder.

It is more desirable that radius of curvature of the developer regulating member is smaller than the radius of curvature of the developer transporting member.

Now, at the time when magnetic toner on sleeve 13 reach the neighborhood of toner regulating area 18, said toner is separated from the sleeve 13 and then magnetically adheres onto the surface of developer regulating means, because the magnetic field around the surface of side 17A of developer regulating member 17 oppositely facing magnet roll 14 is formed strongly. (Provided that developer regulating means 17 is in the shape of a cylinder, the radius of curvature thereof is effectively smaller than the distance between N and S poles on the outer circumferential surface of the magnet roll). And, as shown in FIG. 3, a magnetic pole of developer regulating means 17 were inductively magnetized and said inductive magnetic pole revolvingly moves in the opposite direction to the direction of the revolution of magnet roll 14 with the revolution of magnet roll 14. At this time, magnetic toner 16B, which has separated from aforesaid sleeve 13 and had adhered to developer regulating means 17, moves on the surface of developer regulating means 17 with the revolution of the inductive magnetic poles. The direction of the movement of the aforesaid magnetic toner is different from that of the magnetic toner on sleeve 13 and the reason for this is presumably that, in the movements of a magnetic field produced by the revolution of magnetic roll 14 on sleeve 13, the direction of the magnetic field on the surface of developer regulating means 17 is nearly vertical to the surface of developer regulating means 17, therefore, the said magnetic toner moves in parallel as the magnetic field moves on, while the direction of the magnetic field of the neighborhood of sleeve 13 is antiparallel on the surface of sleeve 13.

Thereafter, at the time when S'-pole on magnet roll 14 which inductively magnetized Ⓝ'-pole on developer regulating means 17 is further revolved and moved to the position of S''-pole, the aforesaid Ⓝ-pole will only by inductively magnetized to a very low degree. Magnetic toner 16B which adhered magnetically to said N -pole will move gradually to the position of Ⓝ'-pole and when it further move toward the right underneath developer regulating means 17, it will at the same time lose its magnetic adhesiveness and fall (the state thereof is shown by the white arrow in FIG. 2). And, in FIG. 2, by way of scraping off magnetic toner 16B from the surface of the developer quantity regulating means by using of scraping member 20, it is effectively attainable to transport and to remove magnetic toner on developer regulating means 17 together with magnetic toners 16B which fell because they lost their magnetic adhesiveness, for the purpose of regulating the quantity thereof.

Thus, it has been possible to regulate the quantity of magnetic toner to be transported to a developing area, in other words, to form a magnetic toner layer uniformly and thinly on said developer regulating means, that is an object of the present invention, by way of magnetically removing magnetic toner and then by way of transporting them to other place on a developer transporting means (i.e., a sleeve in the above description).

Magnetic toners on the circumferential surface of a developer regulating means are not, of course, to be wholly removed, but the space between the developer transporting means and the said developer regulating means must be fixed so that the layer thickness of developer can be suitable for copying within the desired range of the thickness thereof, for example, from several tens μm to 700 μm or thereabouts. Developing apparatuses vary in configuration of the magnet roll thereof and in the magnetic field and the spaces of the magnetized poles, and also vary in the configuration and the magnetic permeability of a member to be used for a developer regulating means, therefore, the force given by said developer regulating means for removing and transporting magnetic toner remaining on the outer circumferential member (hereinafter referred only to as sleeve) of a developer transporting means varies. Accordingly, it is desired to provide with the space between the sleeve and the developer regulating means so as to be adjustable.

Next, the above developer regulating means can be built so that the surface thereof can be smooth and cannot be contaminated or rusted by coating it thinly with resin.

Figure 4:
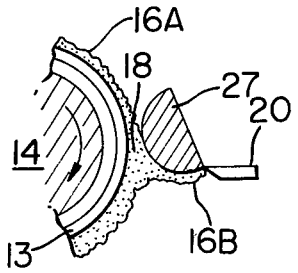
FIG. 4 is a view in the area of a developer regulating means, being a modified example of FIG. 2.

Further, as shown in FIG. 4, it is also possible to form a developer regulating means in which only the area for magnetic toner is regulated, that is, the vicinity of the developer regulating area 18, comprises a magnetic material 27 in a semicylindrical form having a curved surface.

Figure 5:
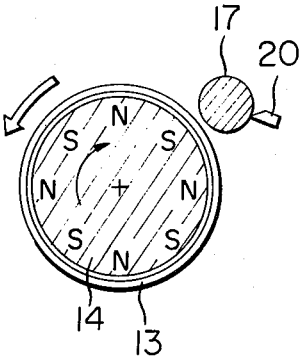
FIG. 5 is a view of a portion of an example of the present invention, wherein the outer circumferential member (sleeve) of a developer transporting means is rotated.

The above description is referred to the example of a developer transporting means comprising a magnetically revolving member (a magnet roll) which was provided revolvably and an outer circumferential member (a sleeve), both of which were fixedly arranged about said magnet roll as as to be coaxial, and as shown in FIG. 5, the transportability of magnetic toner for the developing area can be increased by rotating a sleeve 13 in the opposite direction (as shown by the white arrow) to the direction of the revolution (as shown by the black arrow in FIG. 5) of a magnet roll 14.

Figure 6:
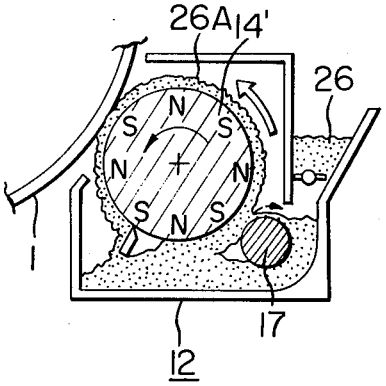
FIG. 6 is a view simply illustrating an example of a magnetically revolving member which itself serves as a developer transporting means.

Further, as shown in FIG. 6, it is also possible to build a developer transporting means consisting essentially of a magnetic revolving member 14' (a magnet roll). In this case, as shown in FIG. 6, the outer circumferential surface of magnet roll 14' is flat and smooth, and rotates in the direction of the black arrow shown in the figure, and magnetic toner 26 on said magnet roll 14' is then transported in the direction of the white arrow shown in the figure. Different from the examples given in the drawings from FIG. 2 to FIG. 4, the revolution of the magnet roll 14' is in a counter-clockwise direction, therefore, the moving direction (shown by the broken line and the arrow) of magnetic toner 26A which are to be transported and removed for regulating a layer thickness of toner becomes one the side of the tranport direction (in the direction of the white arrow) of the developer 26A which remained (on the sleeve) after the quantity of the developer was regulated at the position of developer regulating means 17, and the positional correlation of each member change.

Up to this point, the description has been limited only to the case in which the revolving direction of a charge retaining member and the direction to which developer, particularly magnetic toner, are transported are the same (i.e., a positive revolution) in a developing area, however, it is a matter of course that the present invention is applicable also in the case that the revolving direction of a charge retaining member is opposite to the transport direction of developer.

The description of a preliminarily regulating member 19 shown in FIG. 2 was made herein that it preliminarily regulates developer mechanically, however, a developer regulating means of the present invention can be used for such preliminary regulating process.

And, the above description has concentrated in the case of using magnetic toner in a one-component developing method, from beginning to the end, however, as described in the beginning of the description, in a two-component developing method also, it is possible to regulate a two-component developer on a par with magnetic toner by means of the developer regulating means of the present invention if a magnet for forming a magnetic brush is made serve as a revolvable magnet roll.

By the application of the present invention as described above, it is possible to provide a developing apparatus having the great advantages that it is easily possible to regulate thinly and uniformly the layer thickness of magnetic developer which are supported on a developer transporting means, and there does not result any cohered mass inside the said magnetic developer, and also even if a cohered mass of magnetic developer produced by some other cause mixed in the said developing apparatus, the space of a toner regulating area is not chocked up therewith but removed and transported by means of a developer quantity regulating means.

What is claimed is:

1. In a developing apparatus for producing an electrostatic latent image on a charge retaining member, in which means producing a shifting magnetic field are provided for transporting a magnetic toner from a toner source to a developing area on said retaining member, the improvement comprising means regulating the amount of toner transported comprising a magnetizable member positioned adjacent said transporting means between said toner source and said developing area, said magnetizable member having an external form whose outer surface is spaced sufficiently close to said transporting means and of such shape that the shifting magnetic field of said transporting means induces a shifting magnetic field on the surface of said magnetizable member to attract excess toner from said transporting means.

2. In a developing apparatus, the improvement according to claim 1, in which the surface of said magnetizable member adjacent said transporting means is curved.

3. In a developing apparatus, the improvement according to claim 2, in which said toner transporting means has an outer cylindrical shape and in which the radius of curvature of said toner transporting member is greater than the radius of curvature of said magnetizable member.

4. In a developing apparatus, the improvement according to claim 3, in which said magnetizable member has the shape of a cylinder.

5. In a developing apparatus, the improvement according to claim 3, in which said charge retaining member is a drum, and in which said cylindrical toner transporting means comprises a nonmagnetic sleeve and a magnet roll having adjacent circumferentially spaced north-south poles rotating within said sleeve.

6. In a developing apparatus, the improvement according to claim 3, in which said charge retaining member is a drum, and in which said cylindrical toner transporting member is a cylindrical rotating magnetic roll having adjacent circumferentially spaced north-south poles.

7. In a developing apparatus, the improvement according to claim 3, in combination with a preliminary toner thickness regulating member positioned adjacent said cylindrical transporting means where the toner ascends on said transporting means prior to meeting said magnetic member.

8. In a developing apparatus, the improvement according to claim 1, in combination with means removing accumulated toner from the surface of said magnetic member and directing it to said toner source.

9. In a developing apparatus, the improvement according to claim 8, in which said last means is a preliminary toner thickness regulating member positioned adjacent said toner transporting means between said toner source and said magnetic member.

10. In a developing apparatus, the improvement according to claim 1, in which the magnetizable member is formed of such a substance and whose shape is such that the resulting shifting magnetic field induced upon said magnetizable member is less than the shifting magnetic field produced by said transporting means.

* * * * *